United States Patent [19]

Fuhrmann et al.

[11] 4,248,074

[45] Feb. 3, 1981

[54] AXIAL ROLL ADJUSTMENT FOR A ROLLING MILL

[75] Inventors: Wilhelm Fuhrmann, Wexford; Andrew J. Sofranko, Pittsburgh, both of Pa.

[73] Assignee: Schloemann-Siemag, Inc., Pittsburgh, Pa.

[21] Appl. No.: 31,888

[22] Filed: Apr. 20, 1979

[51] Int. Cl.[3] ..... B21B 31/18

[52] U.S. Cl. ..... 72/247

[58] Field of Search ..... 72/247, 237

[56] References Cited

U.S. PATENT DOCUMENTS

| | | | |
|---|---|---|---|
| 2,774,263 | 12/1956 | Leufven | 72/247 X |
| 4,191,042 | 3/1980 | Salter, Jr. | 72/247 |

FOREIGN PATENT DOCUMENTS

| | | | |
|---|---|---|---|
| 889062 | 2/1962 | United Kingdom | 72/247 |

*Primary Examiner*—Milton S. Mehr

*Attorney, Agent, or Firm*—Thomas H. Murray; Clifford A. Poff

[57] ABSTRACT

Apparatus at the operator's side of a rolling mill is used to move the chock for one of a pair of rolls in an axial direction thereof for alignment between roll pass openings in the bodies of the pair of rolls. The apparatus includes a chock extension sleeve having an externally-threaded surface and a flange at one end attached by bolts to the roll chock at the operator's side. Two nut members are jammed together under sufficient torque for a stressed engagement with the threaded surface of the sleeve. The nut members are joined together by a threaded bolt for simultaneous rotation of the nut members. Gear teeth are formed on an outer annular section of one of the nut members to mesh with a pinion gear rotatably supported by a clevis forming part of the keeper blocks supported by the mill housing. The outwardly-projecting section forming the gear teeth is engaged by support surfaces in the forked end of the clevis to retain the nut members and cause upon rotation thereof displacement of the chock extension sleeve as well as the chock in a direction which is parallel to the rotational axis of the roll.

9 Claims, 4 Drawing Figures

FIG. 3
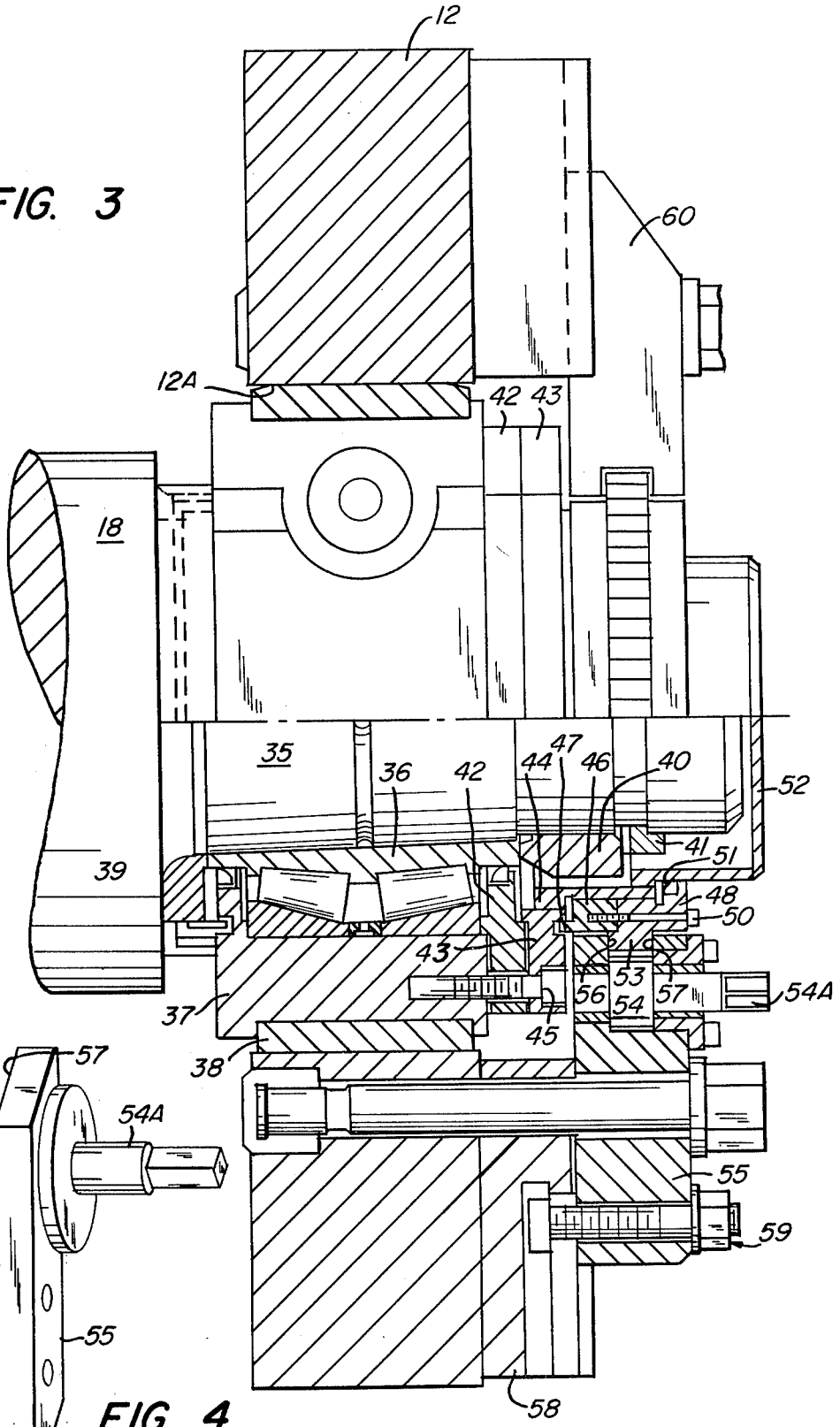
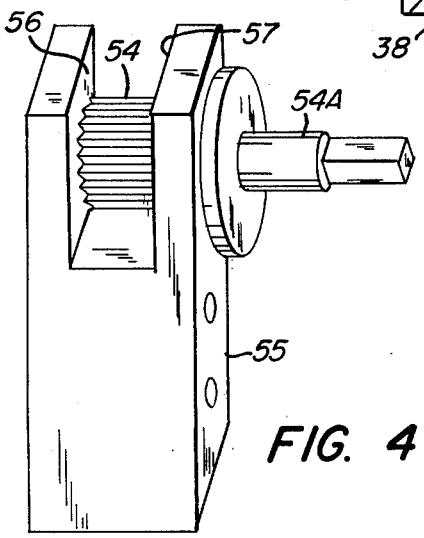
FIG. 4

AXIAL ROLL ADJUSTMENT FOR A ROLLING MILL

BACKGROUND OF THE INVENTION

This invention relates to an apparatus to control the relative axial position of a pair of rolls each having a bearing journal at opposite ends of a roll body for rotatable support by bearing chocks within one of the windows of a pair of spaced-apart mill housings. More particularly, the present invention relates to such an apparatus which includes a keeper plate with a clevis at one end thereof supported by a mill housing to engage opposite sides of a gear ring member while the gear teeth thereon mesh with a pinion gear carried by the keeper plate; the arrangement of parts being such that the gear ring member is connected to a pair of jam nuts threadedly stressed on an annular chock extension member for moving the chock in a direction into or out of the mill housing.

In the rolling of metal with grooved rolls such as commonly employed in a 2-high rolling mill for producing rods, bars, billets, shaped products and the like, the rolls are positioned with respect to one another through adjustments in two planes. The first roll adjustment is carried out by employing screwdown assemblies supported by the mill housings to engage the chocks at opposite ends of one of the rolls to move the chocks along a housing window and thereby position the body of the roll relative to the body of the other roll which is usually stationary within the mill housing. The second roll adjustment is in a direction which is parallel to the rotational axis of the roll for the purpose of aligning the pass openings in one roll with respect to the pass openings in the cooperating roll. The rolls are usually anchored against axial movement by keeper plates attached to the mill housing and engaging at least one of the bearing chocks for each of the rolls. Because of the forces involved which sometimes bring about a resolution of forces in the axial direction of the roll, the anchoring thereof against axial movement as well as the apparatus used to carry out axial adjustment of the roll must be robust and at the same time effectively controllable for accurate and small amounts of movement of the roll in an axial direction. The apparatus employed for retaining the roll against axial movement within the housing windows and for axial adjustment of the roll must not impede removal and/or replacement of the roll assemblies which is required from time-to-time.

SUMMARY OF THE INVENTION

It is an object of the present invention to provide an improved construction and arrangement of parts of support a roll assembly against axial displacement during operative use in a rolling mill and at the same time to effect precise axial positioning of the roll assembly within the rolling mill.

It is a further object of the present invention to integrate the axial support and axial adjustment of a roll assembly in a rolling mill with a keeper plate member.

It is still a further object of the present invention to provide an apparatus to adjust and hold a roll assembly in a direction along its rotational axis by apparatus which is comprised of a minimum of parts to minimize the capital investment required and at the same time functionally efficient during operation and readily removable for changing of rolls in a rolling mill.

More particularly, according to the present invention, there is provided apparatus to axially position one of a pair of rolls each having a bearing journal at opposite ends of a roll body for rotatable support by bearings carried in chocks within one of the windows of a pair of spaced-apart mill housings, the apparatus including the combination of chock extension means including a threaded surface extending from one of the chocks outwardly from the window of the housing supported thereby, first and second nut members each having threads for engaging the threaded surface of the chock extension means, a pin member to interlock the first and second nut members for simultaneous rotation thereof while threadedly abutted together under sufficient torque to stress the threaded surface of the chock extension means with the threads of the nut members, gear means supported by one of the first and second nut members, a pinion gear having teeth to mesh with the gear means, and keeper block means carrying the pinion gear to mesh with the gear means while supported by one of the housings to simultaneously rotate the first and second nut members, the keeper block means including bearing surfaces to hold the nut members for threadedly displacing the chock extension means and the chock together with the roll supported thereby in an axial direction of the roll upon rotation of the pinion gear.

In the preferred form of the present invention, the aforementioned keeper block means includes a clevis with the forked end thereof defining bearing surfaces to engage surfaces at opposite sides of a member defining the gear teeth. The apparatus further includes an end cap secured to the chock extension means for enclosing one end portion of the roll including the bearing while operatively supported by the bearing chock. Seal means carried by one of the first and second nut members engage the end cap to form a protective barrier for the threads of the nut members and the chock extension member. The chock extension means includes a sleeve having an externally-threaded surface for engaging the first and second nut members. The chock extension means further includes a collar secured to one end of the sleeve for removable attachment to one of the chocks. The gear means carried by one of the nut members is integral therewith.

These features and advantages of the present invention as well as others will be more fully understood when the following description is read in light of the accompanying drawings, in which:

FIG. 3 is a partial sectional view taken along line III—III of FIG. 1; and FIG. 4 is an enlarged perspective view of the keeper plate device for holding and adjusting a roll in an axial direction thereof.

Figure 1:
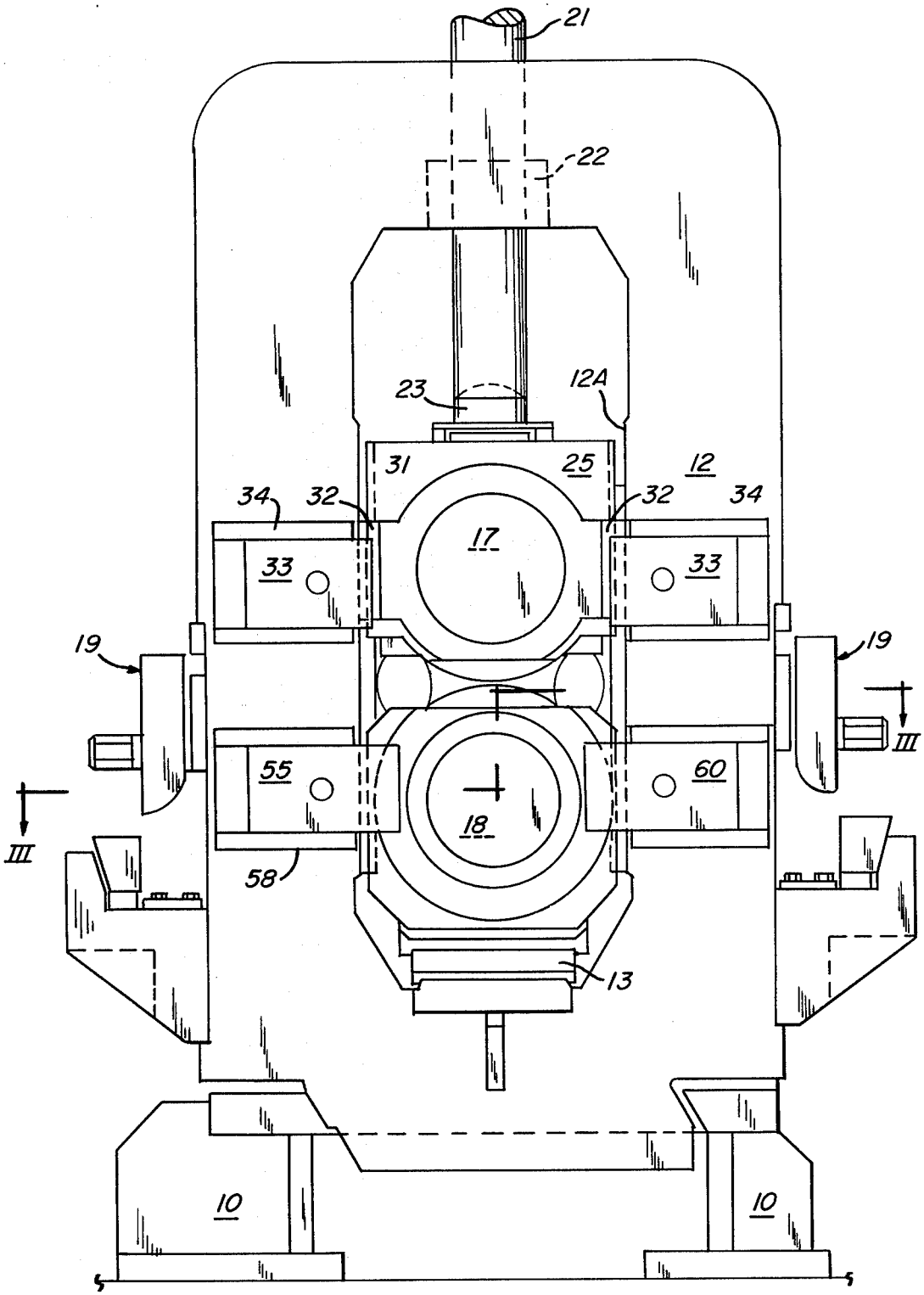
FIG. 1 is an end elevational view from the operator's side of a rolling mill embodying the features of the present invention.
Figure 2:
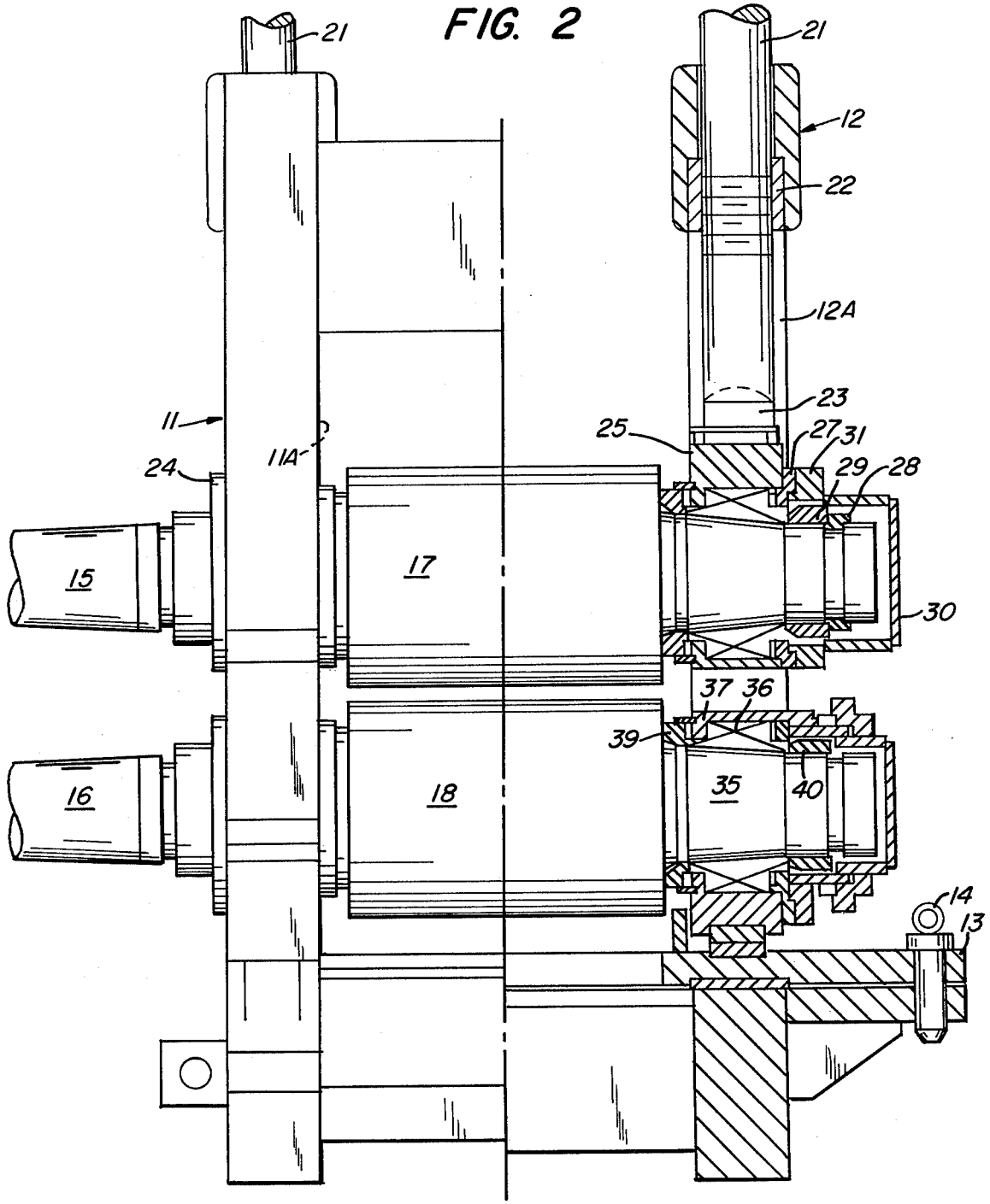
FIG. 2 is a front elevational view, partly in section, of the rolling mill shown in FIG. 1.

A 2-high rolling mill of the type suitable for processing bars, billets, rods, shaped products and the like workpieces is shown in FIGS. 1 and 2 and includes bedplates 10 to support spaced-apart mill housings 11 and 12 having the usual housing windows 11A and 12A, respectively. A sled 13 normally extends through the bottom of the housing windows where it is locked in place by an anchor pin 14 to the operator's side of the mill. At the other side of the mill which is the drive side, spindles 15 and 16 are coupled to the ends of upper and lower rolls 17 and 18, respectively. A series of grooves, not shown, extends within the body portions of the rolls for defining roll pass openings wherein a workpiece is processed. Rest bars and guide assemblies 19 at the entry and delivery sides of the mill direct and receive the workpieces into and from desired roll pass openings in the rolls. The gap between the pair of rolls is controlled by the operation of a screwdown mechanism in a manner which is per se well known in the art.

As shown in FIGS. 1 and 2, screws 21 are threadedly engaged with nuts 22 while supported in recesses formed in the top portions of the housings so that the ends of the screws are adjustably extendible within the housing windows to engage spacer blocks 23, one of which is provided on the top surface of each upper roll chocks 24 and 25. These chocks support bearings while fitted onto the journal portion of the upper roll 17. A ring member 27 (FIG. 2) is used to retain the bearing within each of the roll chocks. The cooperation between a split ring 28 and a solid ring 29 retains the bearing on the journal portion of the roll. At the operator's side, an end cap 30 is attached by a flange 31 to the bearing chock. As shown in FIG. 1, the flange 31 includes oppositely-projecting wing portions 32 which extend to each of the housing posts but outwardly spaced therefrom where the flanges are engaged by clevis end parts of keeper plates 33. The keeper plates are supported in guideways formed in blocks 34 which are attached together with the keeper plates by bolts to the housing posts. By means of the keeper plates, the top roll is secured against axial movement within the windows of the housings 11 and 12. In the embodiment of the invention shown in the drawings, the bottom roll 18 has bearing chocks associated with apparatus for adjusting the roll in the direction of its rotational axis to align the pass openings in the roll 18 with respect to the pass openings in the roll 17. However, it is to be understood that the apparatus as described hereinafter may be employed with equal success to adjust the axial position of roll 17 with respect to bottom roll 18.

As shown in FIGS. 1–3, the bottom roll 18 at the operator's side has a journal 35 received in a bearing 36 that is supported by a chock 37 having wear plates 38 for sliding movement along the vertical face surfaces of the housing windows. The bearing 36 abuts against a spacer 39 located between the chock and the body portion of the roll. At the opposite side of the bearing, a ring 40 abuts against the bearing and retained on the end of the roll by a split ring 41 engaged within a grooved portion of the roll end. A ring 42 carries a seal member for engagement with an annular surface of the bearing. The ring 42 is supported against the face surface of the chock 37 at the operator's side thereof. A chock extension member is made up of a flange 43 secured to one end of a sleeve 44 by weld metal. The flange 43 and seal ring 42 are secured to the chock 37 by bolt members 45 at spaced-peripheral locations about the flange. The sleeve 44 has threads on the external surface thereof from the extended end to a point closely adjacent flange 43. A first nut member 46 is passed along the threaded surface of the sleeve 44 to a point where a rim section 47 extends from one end of the nut into a recess provided in collar 43. The rim 47 and recess in collar 43 provide a seal against the penetration of dirt and other foreign matter to the site of the threaded interconnection between the nut and the sleeve. A second nut member 48 is threaded on the sleeve into an abutting relation with the first nut member 46. To substantially eliminate machining tolerances and other clearances that exist between the threaded portion of sleeve 44 and the threads on nut members 46 and 48, the nut members are jammed together under sufficient torque to stress the threaded interconnection with the sleeve. After the desired torque has been established between the nut members, a fastener in the form of a threaded bolt 50 is used to interconnect the two nut members for simultaneous rotation as a unit. To effect the use of bolt 50, a plurality of holes is formed in the nut member 48 in a direction generally parallel to the threaded surface thereof, the spacing between these holes is non-uniform and varied so that one of the holes will align with a series of non-uniformly spaced and tapped holes in the first nut member 46. The second nut member 48 includes a flange portion which carries a seal 51 to engage the cylindrical wall surface of an end cap 52. The end cap is attached by weld metal to the sleeve portion 44 of the chock extension member.

The second nut member 48 further includes a radially-extending collar section 53 having a face surface onto which there is formed gear teeth that mesh with the teeth of a pinion gear 54. As shown in FIGS. 3 and 4, the pinion gear is rotatably supported in the clevis portion of a keeper plate 55. The pinion gear 54 includes a drive shaft 54A extending to the operator's side of the mill where a squared end is provided for attachment of the drive member. The clevis end portion of the keeper plate 55 is provided with support surfaces 56 and 57 which engage with the opposite face surfaces of the collar section 53. The keeper plate 55 is constrained to linear movement by guide surfaces of a spacer 58. The spacer includes a slotted opening to receive the head portion of a nut and bolt assembly 59 used to retain the keeper plate 55 against the face surface of the spacer block. A second bolt is passed through an opening in the keeper plate into threads supported by the mill housing for attachment with the keeper plate thereto. The arrangement of parts is such that the bolt members are torqued under a sufficient holding force to maintain the position of the keeper plate 55 which is established by proper meshing engagement between the teeth of the worm gear with the teeth formed on the collar section 53. When this meshing relationship is established, the parts are arranged such that the support surfaces 56 and 57 engage opposite sides of the collar section. In this way, movement of the roll assembly in a direction along its axis is restrained in both direction by the support surfaces of the keeper plate. Since the pinion gear meshes with the gear teeth on collar section 53, both nut members are rotated to thereby displace the chock extension member which, in turn, causes the chock 37 to move in the housing window in the direction of the rotational axis of the roll depending, of course, upon the direction of rotation of the nut members. The keeper plate 55 is supported on one post of housing 12 while the other post at the operator's side is provided with a detachable keeper plate 60 having a clevis end portion forming support surfaces corresponding to surfaces 56 and 57 for engagement at opposite sides of gear collar 53.

Although the invention has been shown in connection with a certain specific embodiment, it will be readily apparent to those skilled in the art that various changes in form and arrangement of parts may be made to suit requirements without departing from the spirit and scope of the invention.

What is claimed is:

1. Apparatus to axially position one of a pair of rolls each having a bearing journal at opposite ends of a roll body for rotatable support by bearings carried by chocks within one of the windows of a pair of spaced-apart mill housings, said apparatus including the combination of:

chock extension means including a threaded surface extending from one of said chocks outwardly from the window of the housing supported thereby, first and second nut members each having threads for engaging the threaded surface of said chock extension means, a pin member interlocking said first and second nut members for simultaneous rotation thereof while threadedly abutted together under sufficient torque to stress the threaded surface of said chock extension means with the threads of the nut members, gear means supported by one of said first and second nut members, a pinion gear having teeth to mesh with said gear means, and keeper block means carrying said pinion gear to mesh with said gear means while supported by one of said mill housings to simultaneously rotate said first and second nut members for threadedly displacing said chock extension means and chock together with the roll supported thereby in an axial direction of the roll, said keeper block means including spaced-apart bearing surfaces to hold said nut members against axial movement with the roll.

2. The apparatus according to claim 1 wherein said keeper block means includes a clevis with the forked end thereof defining said spaced-apart bearing surfaces.

3. The apparatus of claim 2 further including an arbor carrying said pinion gear for support by said keeper block with the pinion gear arranged within the forked end of the clevis thereof.

4. The apparatus according to claim 1 further including an end cap secured to said chock extension means for enclosing one end portion of the roll.

5. The apparatus according to claim 4 further including seal means carried by one of said first and second nut members to engage said end cap.

6. The apparatus according to claim 1 wherein said chock extension means includes a sleeve having an external surface with a threaded portion defining said threaded surface.

7. The apparatus according to claim 6 wherein said chock extension means further includes a collar secured to one end of said sleeve for removable attachment to one of said chocks.

8. The apparatus according to claim 1 wherein said pin member includes a threaded bolt.

9. The apparatus according to claim 1 wherein said gear means comprises gear teeth integral with one of said first and second nut members.

* * * * *